US005942704A

United States Patent [19]

Weldon

[11] Patent Number: 5,942,704

[45] Date of Patent: Aug. 24, 1999

[54] BRUSH PLECTRUM FOR STRINGED INSTRUMENTS

[76] Inventor: Matthew Weldon, 733 Parrott Dr., San Mateo, Calif. 94402

[21] Appl. No.: 09/097,717

[22] Filed: Jun. 16, 1998

Related U.S. Application Data

[63] Continuation-in-part of application No. 08/828,742, Mar. 26, 1997.

[51] Int. Cl.[6] ..... G10D 3/16

[52] U.S. Cl. ..... 84/320; 84/321; 84/322

[58] Field of Search ..... 84/320, 321, 322

[56] References Cited

U.S. PATENT DOCUMENTS 4,248,128 2/1981 Des Gaines .
4,651,614 3/1987 Cavallo .
4,790,227 12/1988 Lukehart .
5,194,680 3/1993 Rieneck .
5,271,308 12/1993 Balog .
5,610,349 3/1997 Fogarty et al. ..... 84/322

*Primary Examiner*—William M. Shoop, Jr.
*Assistant Examiner*—Kim Lockett
*Attorney, Agent, or Firm*—Richard C. Litman

[57] ABSTRACT

A plectrum for stringed musical instruments includes a plurality of resilient brush bristles or fibers arranged in a brush-like manner and mounted on the tip of the plectrum. The brush bristles cause multiple, low intensity impacts upon the strings of the instrument with each stroke of the brush plectrum, creating a different and unique harmonic quality than conventional plectrums or those having multiple pick arrays.

6 Claims, 1 Drawing Sheet

BRUSH PLECTRUM FOR STRINGED INSTRUMENTS

CROSS REFERENCE TO RELATED APPLICATION

This application is a continuation-in-part of application Ser. No. 08/828,742 filed on Mar. 26, 1997.

BACKGROUND OF THE INVENTION

1. Field of the Invention

The present invention relates generally to a musical pick and, more particularly, to a brush plectrum for stringed musical instruments.

2. Description of Related Art

Plectrums or picks for stringed musical instruments, such as guitars, mandolins, and basses have been utilized for many years. Such plectrums are generally oval or tear drop shaped, being flat for holding between thumb and finger(s), and made of resilient or non resilient materials in a range of thicknesses.

Conventional plectrums have been designed for use with various stringed instrument, string types, and playing styles, utilizing a range of materials in a vast array of styles depending on the intended use. However, such plectrums have limited ability to vary the tonal qualities and volume of the sound, relying solely on the impact and release of the string on the plectrum to cause vibration of the string. Moreover, this single impact of the string upon the plectrum creates an undesirable clicking sound when each string is engaged and provides no means of varying the tonal qualities once the plectrum disengages the string. The present invention eliminates this clicking sound, while allowing greater control over a variety of tones.

There are several state of the art plectrums for the strumming or picking of stringed musical instruments. The Des Gaines U.S. Pat. No. 4,248,128 discloses a guitar pick array having a multitude of resilient plectrums, installed in a common handle that are used in strumming a guitar. The array is strummed across the strings of the guitar, striking each string a number of times in relation to the number of picks in the array. This pick array has the disadvantage, however, of being rather cumbersome, and of producing an undesirable clicking sound when the picks engage the strings of the guitar.

The patents to Cavallo, U.S. Pat. No. 4,651,614, and to Lukehart, U.S. Pat. No. 4,790,227, are directed to multiple or dual plectrums. These designs display, however, the drawback of creating an undesirable clicking sound when strummed across the strings but also are unwieldy and make articulation or picking of single strings difficult.

Other devices for strumming or picking musical instruments are illustrated in Rieneck U.S. Pat. No. 5,194,680 and Balog U.S. Pat. No. 5,271,308.

None of the above inventions and patents, either singly or in combination, is seen to describe the present invention as described hereinafter and claimed.

SUMMARY OF THE INVENTION

Accordingly, it is an object of the present invention to provide a plectrum or pick for strumming or picking a stringed musical instrument that produces a quieter, smoother sound.

It is also an object of the invention to provide a stringed instrument plectrum that reduces the finger and wrist fatigue caused by the impact of standard plectrums upon the strings of the instruments.

It is another object of the invention to provide a stringed instrument plectrum that allows more control over and subtlety of the tonal qualities of the instrument.

It is another object of the invention to provide a stringed instrument plectrum that eliminates the undesirable clicking sound created by the impact of standard plectrums upon the strings of the instrument.

It is another object of the invention to provide a stringed instrument plectrum that allows for the articulation of single notes, while reducing the amount of string displacement associated with conventional plectrums.

It is further object of the invention to provide a plectrum for the strumming or picking of stringed musical instruments that is economical to manufacture and fully effective in accomplishing its intended purposes.

These and other objects are accomplished by the present invention which provides a brush plectrum for stringed musical instruments comprising a plurality of resilient bristles or brush fibers arranged in a brush-like manner and mounted to the tip of a conventionally-shaped finger plectrum. The brush bristles or fibers of the present plectrum cause multiple, low intensity impacts upon the strings of the instrument with each stroke, creating a different and more unique harmonic or tonal quality than standard plectrums or those having multiple pick arrays. The present brush plectrum provides more control over volume and less fatigue when used for strumming or picking stringed instruments.

The present invention will be more fully understood by reference to the following detailed description thereof when read in conjunction with the attached drawings.

DETAILED DESCRIPTION OF THE PREFERRED EMBODIMENT

Figure 1:
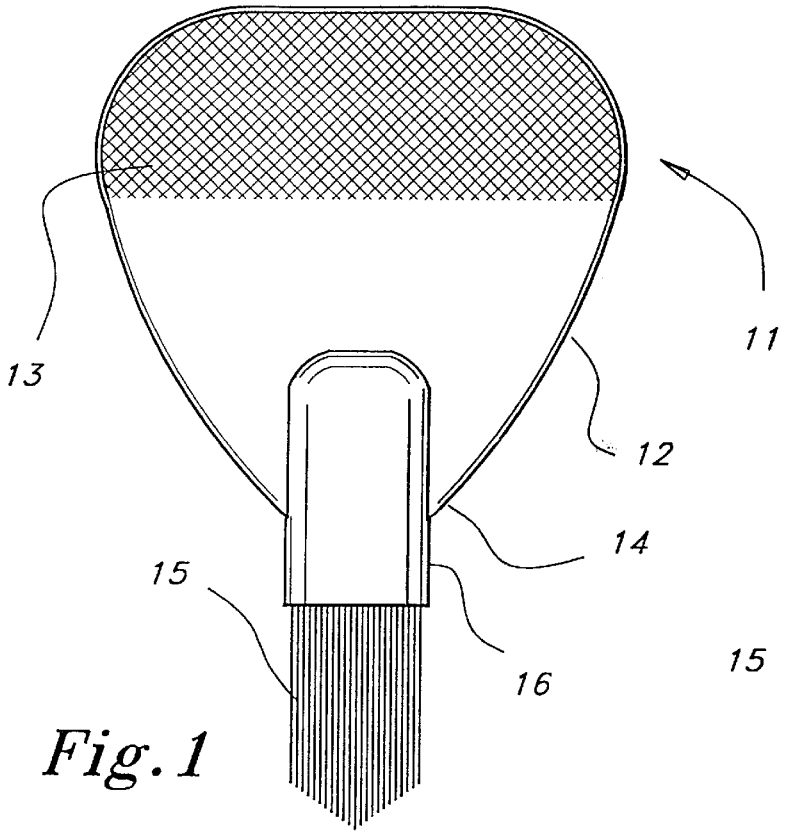
FIG. 1 is a front view of the brush plectrum in accordance with the present invention.
Figure 2:
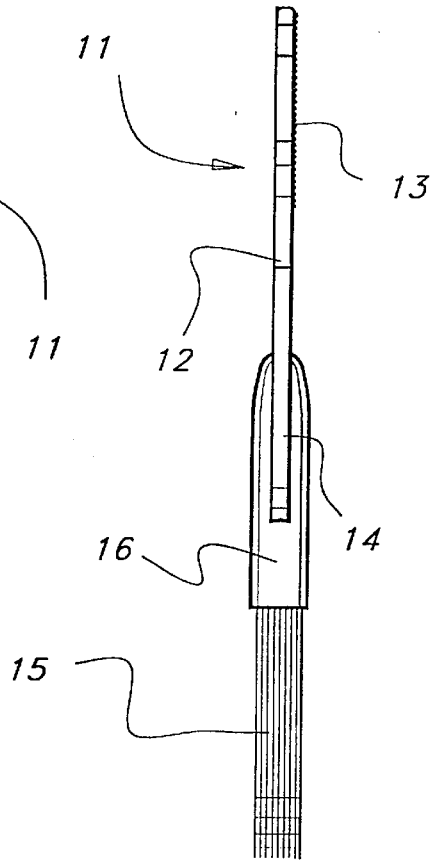
FIG. 2 is a left side view of the present brush plectrum.
Figure 3:
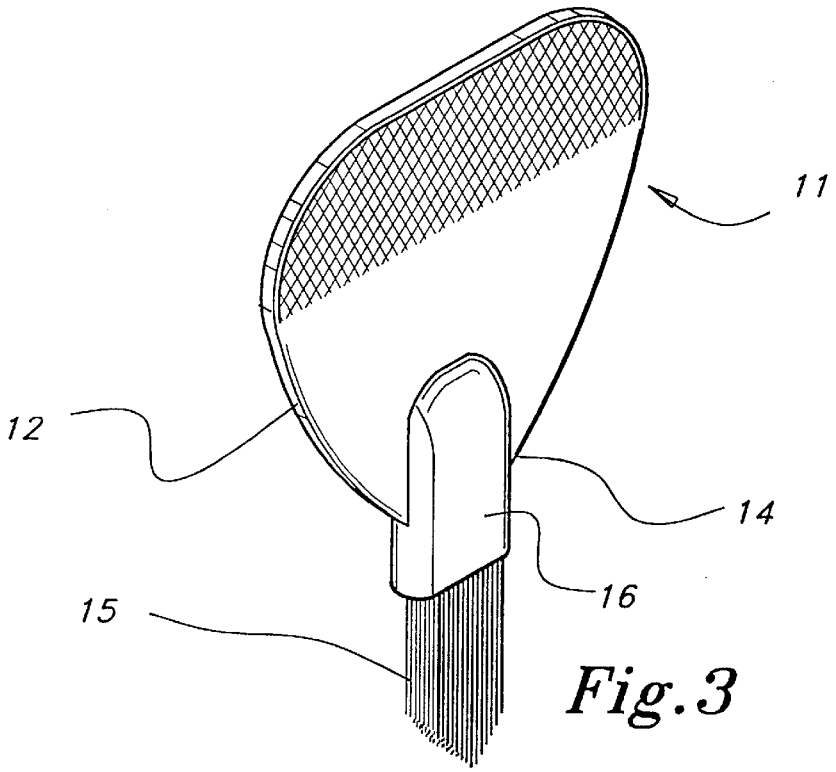
FIG. 3 is a front perspective view of the present brush plectrum.

FIG. 1 shows the stringed instrument brush plectrum of the present invention generally indicated by the reference numeral 11. The brush plectrum 11 is shown to have a tear-drop configuration of unitary construction and includes a gripping portion 13 and a tip portion 14 having a hub 16. Brush plectrum 11 is generally planar and may be constructed of plastic, metal or wood.

Extending from the hub 16 is a plurality of resilient bristles or brush fibers 15 laterally arranged in a plane generally parallel to each other. The brush fibers 15 are preferably made of course synthetic bristles which are held securely at one end thereof within hub 16 by glue or other means.

As best shown in FIG. 1, the free ends or tips of brush bristles 15 are tapered along the sides to form an angle of about 75 to 105 degrees. The gripping portion 13 of the brush plectrum 11 may include a variety of knurl patterns to facilitate gripping of the brush plectrum 11. The gripping portion 13 may also have a variety of configurations for convenient handling of the brush plectrum 11.

It is to be understood that the present invention is not limited to the sole embodiment described above, but encompasses any and all embodiments within the scope of the claims.

I claim:

1. A stringed instrument plectrum comprising:

a substantially planar gripping portion and a tip portion of unitary construction; and a plurality of resilient bristles extending from said tip portion and laterally arranged in a plane generally parallel to one another, said bristles having first ends affixed to said tip portion by securing means and opposite second ends for stroking a stringed musical instrument.

2. The plectrum as set forth in claim 1, wherein said tip portion includes a hub for receiving the first ends of said bristles.

3. The plectrum as set forth in claim 1, wherein the second ends of said bristles define a tapered arrangement forming an angle of about 75 to 105 degrees.

4. The plectrum as set forth in claim 1, wherein said planar gripping portion and a tip portion collectively define a tear drop configuration.

5. The plectrum as set forth in claim 1, wherein said planar gripping portion includes a knurl pattern.

6. The plectrum as set forth in claim 1, wherein said planar gripping portion and a tip portion are constructed of a materials selected from the group consisting of plastic, metal and wood.

* * * * *